US006698234B2

(12) United States Patent
Gopalnarayanan et al.

(10) Patent No.: US 6,698,234 B2
(45) Date of Patent: Mar. 2, 2004

(54) METHOD FOR INCREASING EFFICIENCY OF A VAPOR COMPRESSION SYSTEM BY EVAPORATOR HEATING

(75) Inventors: Sivakumar Gopalnarayanan, Simsbury, CT (US); Tobias H. Sienel, Manchester, CT (US); Lili Zhang, East Hartford, CT (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/102,411

(22) Filed: Mar. 20, 2002

(65) Prior Publication Data

US 2003/0177782 A1 Sep. 25, 2003

(51) Int. Cl.[7] ..... F25B 31/00; F25B 1/10; F25B 41/00; F25B 39/02

(52) U.S. Cl. ..... 62/505; 62/510; 62/513; 62/526

(58) Field of Search ..... 62/510, 513, 526, 62/505

(56) References Cited

U.S. PATENT DOCUMENTS

| | | | | | |
|---|---|---|---|---|---|
| 3,766,745 | A | * | 10/1973 | Quick | 62/196.2 |
| 4,137,058 | A | * | 1/1979 | Schlom et al. | 62/121 |
| 4,362,462 | A | | 12/1982 | Blotenberg | |
| 4,592,204 | A | | 6/1986 | Rice | |
| 4,947,655 | A | * | 8/1990 | Shaw | 62/200 |
| 5,042,268 | A | * | 8/1991 | LaBrecque | 62/278 |
| 5,097,677 | A | * | 3/1992 | Holtzapple | 62/500 |
| 5,245,836 | A | * | 9/1993 | Lorentzen et al. | 62/174 |
| 5,674,053 | A | * | 10/1997 | Paul et al. | 417/228 |
| 5,730,216 | A | | 3/1998 | Viegas et al. | |
| 5,947,712 | A | | 9/1999 | Viegas et al. | |
| 6,298,677 | B1 | | 10/2001 | Bujak et al. | |
| 6,460,371 | B2 | * | 10/2002 | Kawada | 62/505 |

FOREIGN PATENT DOCUMENTS

EP 0 908 688 A2 4/1999

* cited by examiner

*Primary Examiner*—William Doerrler
*Assistant Examiner*—Filip Zec
(74) *Attorney, Agent, or Firm*—Carlson, Gaskey & Olds

(57) ABSTRACT

The efficiency of a vapor compression system is increased by coupling the evaporator with either the intercooler of a two-stage vapor compression system or the compressor component. The refrigerant in the evaporator accepts heat from the compressor component or the refrigerant in the intercooler, heating the evaporator refrigerant. As pressure is directly related temperature, the low side pressure of the system increases, decreasing compressor work and increasing system efficiency. Additionally, as the heat from the compressor component or from the refrigerant in the intercooler is rejected to the refrigerant in the evaporator, the compressor is cooled, increasing the density and the mass flow rate of the refrigerant to further increase system efficiency.

25 Claims, 2 Drawing Sheets

METHOD FOR INCREASING EFFICIENCY OF A VAPOR COMPRESSION SYSTEM BY EVAPORATOR HEATING

BACKGROUND OF THE INVENTION

The present invention relates generally to a method for increasing the efficiency of a vapor compression system by heating the refrigerant in the evaporator with heat provided by the compressor.

Chlorine containing refrigerants have been phased out in most of the world due to their ozone destroying potential. Hydrofluoro carbons (HFCs) have been used as replacement refrigerants, but these refrigerants still have high global warming potential. "Natural" refrigerants, such as carbon dioxide and propane, have been proposed as replacement fluids. Unfortunately, there are problems with the use of many of these fluids as well. Carbon dioxide has a low critical point, which causes most air conditioning systems utilizing carbon dioxide to run transcritical, or above the critical point.

When a vapor compression system runs transcritical, the high side pressure of the refrigerant is typically high so that the refrigerant does not change phases from vapor to liquid while passing through the heat rejecting heat exchanger. Therefore, the heat rejecting heat exchanger operates as a gas cooler in a transcritical cycle, rather than as a condenser. The pressure of a subcritical fluid is a function of temperature under saturated conditions (where both liquid and vapor are present). However, the pressure of a transcritical fluid is a function of fluid density when the temperature is higher than the critical temperature.

In a prior vapor compression system, the heat generated by the compressor motor either is lost by being discharged to the ambient or superheats the suction gas in the compressor. If the heat superheats the suction gas in the compressor, the density and the mass flow rate of the refrigerant decreases, decreasing system efficiency. It would be beneficial to utilize compressor heat to improve system efficiency and reduce system size and cost.

SUMMARY OF THE INVENTION

The efficiency of a vapor compression system can be increased by coupling the evaporator with the compressor to provide heat from the compressor to the refrigerant in the evaporator. An intercooler of a two-stage vapor compression system or a compressor component can also be coupled to the evaporator to provide the heat to the evaporator refrigerant. Preferably, the compressor component is a compressor oil cooler or a compressor motor. The refrigerant in the evaporator accepts heat from the refrigerant in the intercooler or the compressor component, increasing the temperature of the refrigerant in the evaporator. As pressure is directly related to temperature, the temperature of the refrigerant in the evaporator increases, increasing the low side pressure of the refrigerant exiting the evaporator. As the low side pressure increases, the compressor needs to do less work to bring the refrigerant to the high side pressure, increasing system efficiency and/or capacity.

Additionally, as the heat from the refrigerant in the intercooler or the compressor component is rejected to the refrigerant in the evaporator, the refrigerant in the compressor is cooled. By cooling the refrigerant in the compressor, the density and the mass flow rate of the refrigerant in the compressor increases, increasing system efficiency.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
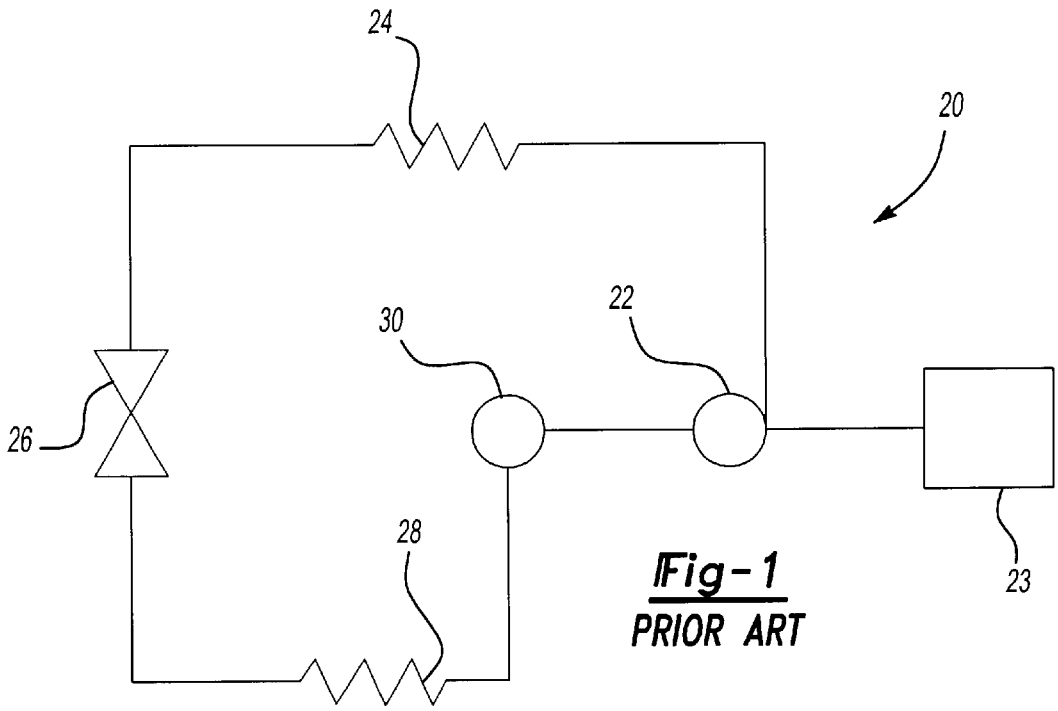
Fig-1 PRIOR ART
FIG. 1 illustrates a schematic diagram of a prior art vapor compression system.

FIG. 1 illustrates a schematic diagram of a prior art vapor compression system 20. The system 20 includes a compressor 22 with a motor 23, a first heat exchanger 24, an expansion device 26, a second heat exchanger 28, and a flow reversing device 30 to reverse the flow of refrigerant circulating through the system 20. When operating in a heating mode, after the refrigerant exits the compressor 22 at high pressure and enthalpy, the refrigerant flows through the first heat exchanger 24, which acts as a condenser or gas cooler. The refrigerant loses heat, exiting the first heat exchanger 24 at low enthalpy and high pressure. The refrigerant then passes through the expansion device 26, and the pressure drops. After expansion, the refrigerant flows through the second heat exchanger 28, which acts as an evaporator, and exits at a high enthalpy and low pressure. The refrigerant passes through the heat pump 30 and then re-enters the compressor 22, completing the system 20. The heat pump 30 can reverse the flow of the refrigerant to change the system 20 from the heating mode to a cooling mode.

In a preferred embodiment of the invention, carbon dioxide is used as the refrigerant. While carbon dioxide is illustrated, other refrigerants may benefit from this invention. Because carbon dioxide has a low critical point, systems utilizing carbon dioxide as a refrigerant usually require the vapor compression system 20 to run transcritical. This concept can be applied to refrigeration cycles that operate at multiple pressure levels, such that those systems having two or more compressors, gas coolers, expansion devices, or evaporators. Although a transcritical vapor compression system is described, it is to be understood that a convention sub-critical vapor compression system can be employed as well. Additionally, the present invention can also be applied to refrigeration cycles that operate at multiple pressure levels, such as systems having more than one compressors, gas cooler, expander motors, or evaporators.

Figure 2:
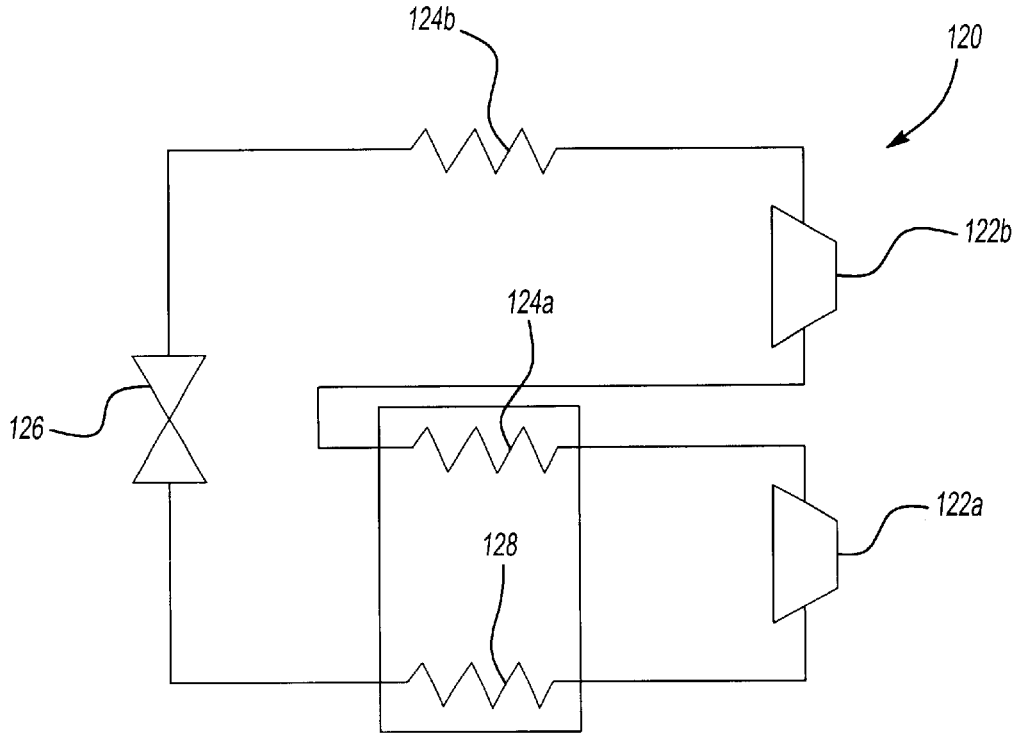
FIG. 2 illustrates a schematic diagram of the evaporator coupled to the intercooler of a multistage vapor compression system to increase efficiency.

FIG. 2 illustrates a multi-stage compression system 120. Like numerals are increased by multiples of 100 to indicate like parts. The system 120 includes an expansion device 126, a second heat exchanger 128 or evaporator, either a single compressor with two stages or two single stage compressors 122*a* and 122*b*, an intercooler 124*a* positioned between the two compressors 122*a* and 122*b*, and a first heat exchanger or gas cooler 124*b*.

In the present invention, the evaporator 128 is coupled to the intercooler 124*a*. Heat from the refrigerant in the intercooler 124*a* is accepted by the refrigerant passing through the evaporator 128. Increasing the temperature of the refrigerant in the evaporator 128 increases the performance of the evaporator 128 and the system 120. As pressure is directly related to temperature, increasing the temperature of the refrigerant exiting the evaporator 128 increases the low side pressure of the refrigerant exiting the evaporator 128.

The work of the compressor 122*a* and 122*b* is a function of the difference between the high side pressure and the low side pressure of the system 120. As the low side pressure increases, the compressors 122*a* and 122*b* are required to do less work, increasing system 120 efficiency. Additionally, as heat is provided by the refrigerant in the intercooler 128, the evaporator 128 is required to perform less refrigerant heating, reducing or eliminating the heating function of the evaporator 128.

As heat in the refrigerant in the intercooler 124*a* is rejected into the refrigerant in the evaporator 128, the temperature of the refrigerant exiting the intercooler 124*a* and entering the second stage compressor 122*b* decreases. This reduces the superheating of the suction gas in the second stage compressor 122*b*, increasing the density and the fluid mass of the refrigerant in the second stage compressor 122*b*, further increasing system 120 efficiency. The discharge temperature of the second stage compressor 122*b* is also reduced, prolonging compressor 122*b* life.

Figure 3:
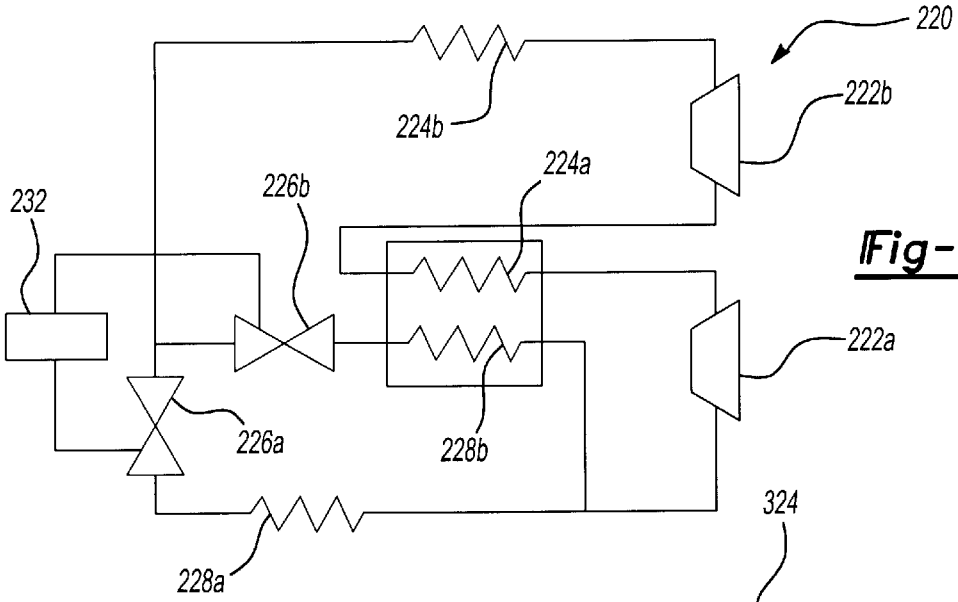
FIG. 3 illustrates an alternative coupling of the evaporator to the intercooler.

Alternatively, as shown in FIG. 3, the multistage vapor compression system 220 includes two evaporators 228*a* and 228*b*. The first evaporator 228*a* is positioned between a first expansion device 226*a* and the first stage compressor 222*a*. The second evaporator 228*b* is positioned between a second expansion device 226*b* and the first stage compressor 222*a* and is coupled to the intercooler 224*a*.

Heat from the refrigerant in the intercooler 224*a* is provided to the refrigerant passing through the second evaporator 228*b* to increase the temperature of the refrigerant exiting the second evaporator 228*b*. Additionally, the temperature of the refrigerant in the intercooler 224*b* is reduced, increasing efficiency of the system 220 by increasing the density and the mass flow rate of the suction gas in the second stage compressor 222*b*.

The first expansion device 226*a* and the second expansion device 226*b* control the flow of the refrigerant through the evaporators 228*a* and 228*b*, respectively. By closing the expansion device 226*a*, the refrigerant flows through evaporator 228*b* and accepts heat from the refrigerant in the intercooler 224*a*. Alternatively, by closing the expansion device 226*b*, the refrigerant flows through evaporator 228*a* and does not accept heat from the refrigerant in the intercooler 224*a*. Both expansion devices 226*a* and 226*b* can be adjusted to a desired degree to achieve a desired flow of the refrigerant through the evaporators 228*a* and 228*b*, respectively. A control 232 monitors the system 220 to determine the optimal distribution of the refrigerant through the evaporators 228*a* and 228*b* and adjusts the expansion devices 226*a* and 226*b* to achieve the optimal distribution. For example, if refrigerant is passing through expansion device 226*a* and the control 232 determines that system 220 efficiency is low, the control 232 will begin to close the expansion device 226*a* and begin to open the expansion device 226*b*, increasing system 220 efficiency. Once a desired efficiency is achieved, the expansion devices 226*a* and 226*b* are set to maintain this efficiency. The factors that would be used to determine the optimum pressure are within the skill of a worker in the art.

Figure 4:
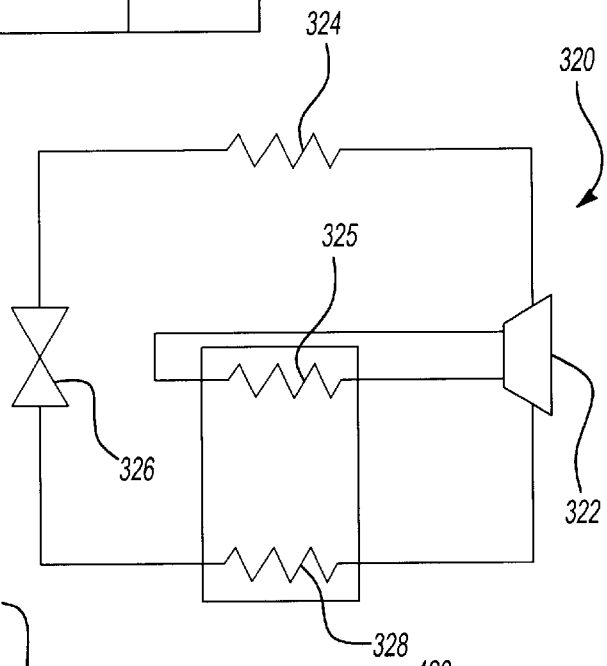
FIG. 4 illustrates a schematic diagram of the evaporator coupled to a compressor component to increase efficiency.

FIG. 4 illustrates a vapor compression system 320 employing an evaporator 328 coupled to a compressor component 325 of a compressor 322. Preferably, the compressor component 325 is a compressor oil cooler or a compressor motor. The compressor 322 heat is accepted by the refrigerant in the evaporator 328. As the temperature of the refrigerant in the evaporator 328 increases, the low side pressure of the system 320 increases, decreasing compressor 322 work and increasing system 320 efficiency. As the temperature of the refrigerant in the compressor 322 decreases, system 320 efficiency increases.

Figure 5:
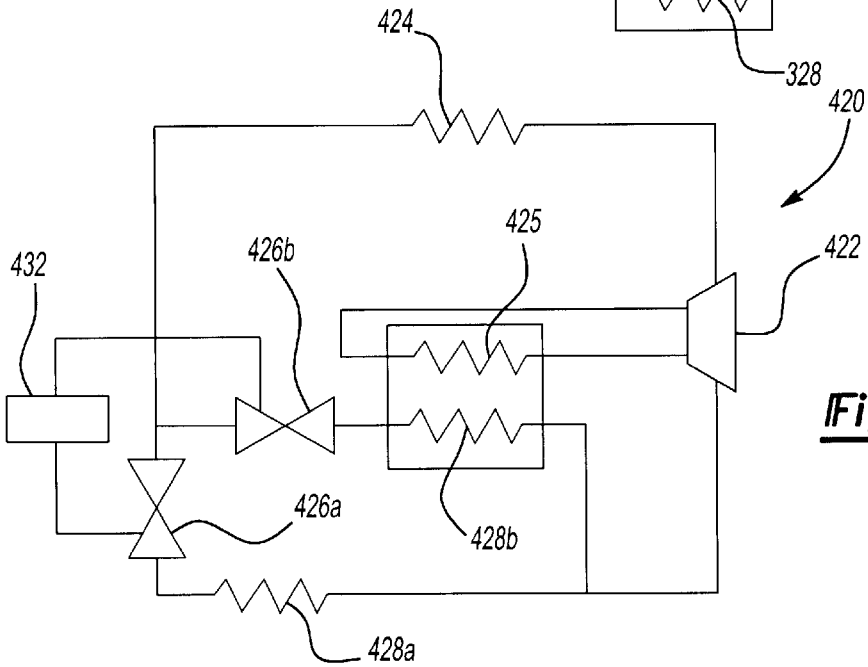
FIG. 5 illustrates an alternative coupling of the evaporator to the compressor component.

Alternatively, as shown in FIG. 5, the system 420 includes two evaporators 428*a* and 428*b*. The first evaporator 428*a* is positioned between a first expansion device 426*a* and the compressor 422, and the second evaporator 428*b* is between a second expansion device 426*b* and the compressor 422. The second evaporator 428*b* is coupled with the compressor component 425 to increase the temperature of the refrigerant in the second evaporator 428*b* and to cool the compressor component 425.

The first expansion device 426*a* and the second expansion device 426*b* control the flow of the refrigerant through the evaporators 428*a* and 428*b*, respectively. By closing the expansion device 426*a*, the refrigerant flows through evaporator 428*b* and exchanges heat with the refrigerant in the compressor component 425. Alternatively, by closing the expansion device 426*b*, the refrigerant flows through evaporator 428*a* and does not exchange heat with the refrigerant in the compressor component 425. Both expansion devices 426*a* and 426*b* can be adjusted to a desired degree to achieve a desired flow. A control 432 monitors the system 420 to determine the optimal distribution of the refrigerant through the evaporators 428*a* and 428*b* and adjusts the expansion devices 426*a* and 426*b* to achieve the optimal distribution. For example, if refrigerant is passing through expansion device 426*a* and the control 432 determines that system 420 efficiency is low, the control 432 will begin to close the expansion device 426*a* and begin to open the expansion device 426*b*, increasing system 420 efficiency. Once a desired efficiency is achieved, the expansion devices 426*a* and 426*b* are set to maintain this efficiency. The factors that would be used to determine the optimum pressure are within the skill of a worker in the art.

Although the intercooler 124*a* and 224*a* and the compressor component 325 and 425 have been described separately, it is to be understood that a vapor compression system could utilize both the intercooler 124*a* and 224*a* and the compressor component 325 and 425 to heat the refrigerant in the evaporator 128, 228, 328*b*, and 428*b*. If both the intercooler 124*a* and 224*a* and the compressor component 325 and 425 are employed, they can be applied either in series or parallel.

Additionally, although it has been disclosed that the evaporators 128, 228*b*, 328 and 428*b* are coupled to the intercoolers and compressor components 124*a*, 224*a*, 325 and 425, respectively, it is to be understood that the internal heat transfer between these components could occur through a third medium, such as air.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A vapor compression system comprising:

a compression device to compress a refrigerant to a high pressure;

a heat rejecting heat exchanger for cooling said refrigerant;

an expansion device for reducing said refrigerant to a low pressure; and a heat accepting heat exchanger for evaporating said refrigerant, wherein said refrigerant in said heat accepting heat exchanger exchanges heat with and accepts heat from said compression device.

2. The system as recited in claim 1 wherein said compression device includes a first compression stage and a second compression stage, and an intercooler is positioned between said compression stages to further cool said refrigerant passing through said intercooler, and said intercooler is coupled to said heat accepting heat exchanger such that heat from said refrigerant in said intercooler is rejected to said refrigerant in said heat accepting heat exchanger.

3. The system as recited in claim 2 wherein said heat accepting heat exchanger includes a first heat accepting heat exchanger and a second heat accepting heat exchanger, and said second heat accepting heat exchanger is coupled to said intercooler such that heat from said refrigerant in said intercooler is rejected to said refrigerant in said second heat accepting heat exchanger.

4. The system as recited in claim 3 wherein said expansion device includes a first expansion device controlling flow of said refrigerant through said first heat accepting heat exchanger and a second expansion device controlling flow of said refrigerant through said second heat accepting heat exchanger.

5. The system as recited in claim 4 wherein a control adjusts a degree of opening of said first expansion device and said second expansion device.

6. The system as recited in claim 1 wherein said compression device further includes a component coupled to said heat accepting heat exchanger such that heat from said component is rejected to said refrigerant in said heat accepting heat exchanger.

7. The system as recited in claim 6 wherein said component is a compressor oil cooler.

8. The system as recited in claim 6 wherein said component is a compressor motor.

9. The system as recited in claim 6 wherein said heat accepting heat exchanger includes a first heat accepting heat exchanger and a second heat accepting heat exchanger, and said second heat accepting heat exchanger is coupled to said component such that heat from said component is rejected to said refrigerant in said second heat accepting heat exchanger.

10. The system as recited in claim 9 wherein said expansion device includes a first expansion device controlling flow of said refrigerant through said first heat accepting heat exchanger and a second expansion device controlling flow of said refrigerant trough said second heat accepting heat exchanger.

11. The system as recited in claim 10 wherein a control adjusts a degree of opening of each of said first expansion device and said second expansion device.

12. The system as recited in claim 1 wherein said refrigerant is carbon dioxide.

13. The system as recited in claim 1 wherein said system further includes an additional compression device, an additional hear rejecting heat exchanger, an additional expansion device, and an additional heat accepting heat exchanger.

14. The system as recited in claim 1 further including an additional fluid medium which accepts heat from said compression device, and wherein said refrigerant in said hear accepting hear exchanger accepts heat from said compression device through said additional fluid medium.

15. The system as recited in claim 1 wherein said refrigerant in said heat accepting heat exchanger further accepts heat from said refrigerant in said compression device.

16. A method of increasing capacity of a transcritical vapor compression system comprising the steps of:

compressing a refrigerant to a high pressure;

cooling said refrigerant;

expanding said refrigerant to a low pressure;

evaporating said refrigerant; and transferring heat from the compressing step to the evaporating step.

17. The method as recited in claim 16 wherein the compressing step includes first compressing said refrigerant and second compressing said refrigerant and further includes the step of intercooling said refrigerant between the steps of first compressing and second compressing.

18. The method as recited in claim 17 wherein the transferring from the step of compressing includes transferring heat from the step of intercooling.

19. The method as recited in claim 16 wherein the step of compressing said refrigerant includes the step of cooling compressor oil.

20. The method as recited in claim 19 wherein the step of transferring heat from the step of compressing includes transferring heat from the step of cooling compressor oil.

21. The method as recited in claim 16 wherein the step of compressing said refrigerant includes the step of cooling a compressor motor.

22. The method as recited in claim 21 wherein the step of transferring heat from the step of compressing includes transferring heat from the step of cooling said compressor motor.

23. The method as recited in claim 16 wherein said refrigerant is carbon dioxide.

24. The method as recited in claim 16 wherein the step of transferring heat from the compressing step to the evaporating step includes exchanging heat between said refrigerant in the step of compressing and said refrigerant in the step of evaporating.

25. A vapor compression system comprising:

a compression device to compress a refrigerant to a high pressure;

a heat rejecting heat exchanger for cooling said refrigerant;

an expansion device for reducing said refrigerant to a low pressure; and a heat accepting heat exchanger for evaporating said refrigerant, wherein said refrigerant in said heat accepting heat exchanger further accepts heat from said refrigerant in said compression device.

* * * * *

UNITED STATES PATENT AND TRADEMARK OFFICE

CERTIFICATE OF CORRECTION

PATENT NO. : 6,698,234 B2
DATED : March 2, 2004
INVENTOR(S) : Gopalnarayanan et al.

It is certified that error appears in the above-identified patent and that said Letters Patent is hereby corrected as shown below:

Column 8,
Line 57, “trough” should read as -- through --

Column 9,
Lines 3, 7 and 8, “hear” should read as -- heat --
Line 27, insert -- step -- after “transferring” and before “from”

Signed and Sealed this

Twenty-fifth Day of May, 2004

JON W. DUDAS
*Acting Director of the United States Patent and Trademark Office*